US007284300B1

(12) United States Patent
Bruns

(10) Patent No.: US 7,284,300 B1
(45) Date of Patent: Oct. 23, 2007

(54) GRIP FOR A HANDLE

(76) Inventor: Nancy L. Bruns, 312 Ross Ave., Hamilton, OH (US) 45013

( * ) Notice: Subject to any disclaimer, the term of this patent is extended or adjusted under 35 U.S.C. 154(b) by 0 days.

(21) Appl. No.: 11/016,510

(22) Filed: Dec. 17, 2004

Related U.S. Application Data

(60) Provisional application No. 60/533,960, filed on Jan. 2, 2004.

(51) Int. Cl.
*A45C 3/00* (2006.01)

(52) U.S. Cl. ..... 16/430; 16/110.1

(58) Field of Classification Search ..... 16/430, 16/431, 429, 435, 436, 440, 421, 422, 426, 16/110.1, 111.1, DIG. 12, DIG. 18, DIG. 19; 74/551.9; D8/303
See application file for complete search history.

(56) References Cited

U.S. PATENT DOCUMENTS 3,868,110 A * 2/1975 Jones ..... 473/551
D267,147 S * 12/1982 Jannard ..... D8/303
4,645,235 A * 2/1987 Joseph ..... 280/821
4,785,495 A * 11/1988 Dellis ..... 16/421
D300,506 S * 4/1989 Pedone ..... D8/303
5,326,340 A * 7/1994 Coffey ..... 482/93
5,365,881 A * 11/1994 Sporn ..... 119/633
5,556,092 A 9/1996 Theken
5,626,430 A * 5/1997 Bistrack ..... 401/6
5,692,265 A * 12/1997 Dalury ..... 16/430
5,829,099 A * 11/1998 Kopelman et al. ..... 16/430
5,873,148 A * 2/1999 Arnold ..... 16/430
6,145,151 A * 11/2000 Herron et al. ..... 15/143.1
6,988,295 B2 1/2006 Tillim
2004/0107621 A1* 6/2004 Segalle ..... 42/71.02

* cited by examiner

*Primary Examiner*—William L. Miller
(74) *Attorney, Agent, or Firm*—Ronald J. Richter; Hasse & Nesbitt LLC

(57) ABSTRACT

A grip for improving the mechanics of any hand function comprises a body having dorsal, ventral and two side surfaces, wherein the dorsal surface has a depression for the placement of the heel of the hand, a prominence fitting the palm of the hand, a ridge separating the thumb and forefinger of the hand, and a depression for the placement of the thumb; and wherein the ventral surface has a plurality of depressions for the four digits of the hand; and wherein the two lateral surfaces separate the dorsal from the ventral sides and optionally provide alternative depressions for the placement of the thumb.

4 Claims, 3 Drawing Sheets

GRIP FOR A HANDLE

CROSS-REFERENCE TO RELATED APPLICATION

This application claims the benefit of the filing date of U.S. Provisional Application No. 60/533,960, filed Jan. 2, 2004.

FIELD OF THE INVENTION

This application relates generally to a gripping device that can be employed or utilized on, or as, a variety of handles or hand-resting surfaces. More specifically, the disclosed gripping device accommodates all the digits, thumb and contours of the human hand to provide an enhanced grip that facilitates and/or improves the performance of a variety of tasks associated with hand placement or movement of the upper limb.

The disclosed grip is ergonomically designed and symmetrically balanced. It is ambidextrous in the sense that it fits either hand, and it features alternative placement sites for the thumb when a different gripping intensity or orientation is needed for a particular chore.

DESCRIPTION OF THE PRIOR ART

Needless to say, there is no shortage of references describing contoured handles or grips to improve the working or resting relationship between a machine and the human hand. Countless designs featuring a variety of ridges, valleys and dips, allegedly conforming with the contour of the hand in an improved fashion, have been devised and described since the application of force to a machine. Patents relevant to the handle grip disclosed herein include U.S. patent application Publication No. 2003/0074766, which was published on Apr. 24, 2003 describing a handle grip providing a shape and structure the fills various regions of the hand except a region in an area over the underlying carpal tunnel. U.S. Pat. No. 5,556,092, which issued to Theken on Sep. 17, 1996, describes a handle grip having undulating surfaces to provide a comfortable non-slip surface in the user's hand and has gripping ridges, gripping valleys and a plurality of ovoid dimples to increase the surface of interface between the user's fingers and the handle. U.S. Pat. No. 5,873,148, which issued Feb. 23, 1999 to Arnold, describes a handle system to fit the fingers of a hand. The system includes individual segments, having grooves to accommodate the fingers of a hand that are axially disposed on a center member that engages the handle of a tool. Also relevant to the disclosed gripping device is an assortment of design patents, including Des. 300,506 and Des. 267,147, but neither suggests nor describes the features of the instantly disclosed gripping device.

SUMMARY OF THE INVENTION

Notwithstanding the plethora of clever gripping features described and disclosed on the handles and gripping surfaces of the prior art, there remains a need to provide a gripping surface that accommodates the grip of the entire or complete gripping surface of the human hand. Specifically, the disclosed grip comprises a body having a dorsal or top surface with a depression for the heel of the hand, a prominence for the palm of the hand, an elevated ridge to separate the thumb and forefinger of the hand and a depression for the placement of the pad of the thumb. The grip also has a ventral surface having a plurality of depressions for the placement of the tips or pads of the four digits of the hand and two lateral surfaces separating the dorsal and ventral surfaces and optionally having a depression on each lateral surface providing an alternative depression for the placement for the pad of the thumb.

DESCRIPTION OF THE PREFERRED EMBODIMENTS

Figure 1:
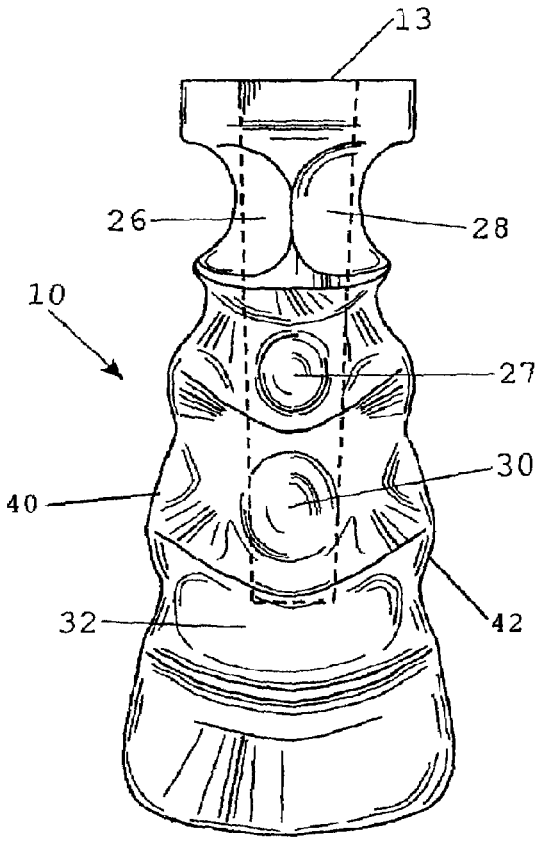
FIG. 1 is a plan view of the ventral surface of the disclosed grip.
Figure 2:
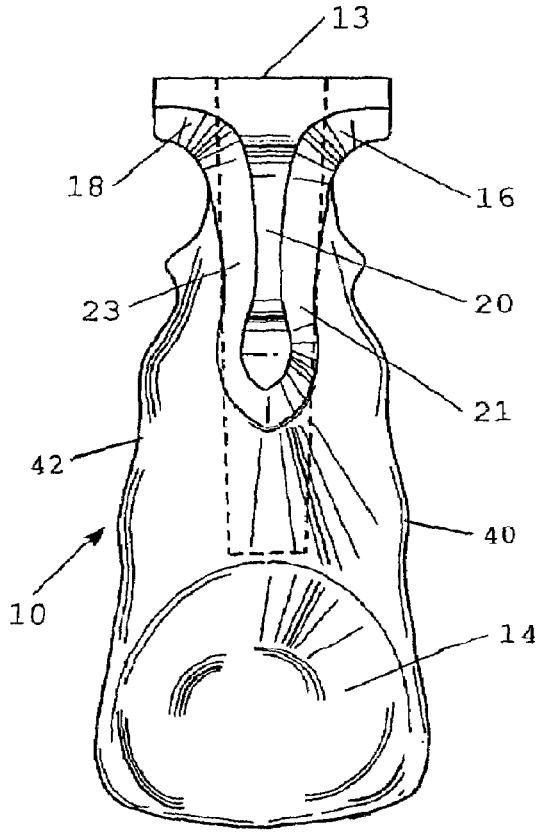
FIG. 2 is a plan view of the dorsal surface of the disclosed grip.

Almost all of the features of the disclosed grip 10 are readily apparent from FIGS. 1 and 2. FIG. 1 depicts the ventral underside of the grip and FIG. 2 depicts the dorsal or top side of the grip 10. Referring initially to FIG. 2, the most prominent features of the grip 10 are the depression 14 and ridge 20. These features suggest the appropriate placements for the typical orientation of the gripping hand. Depression 14 provides a logical location for the placement of the heel of the hand, and ridge 20 fits logically between the thumb and forefinger of the hand. And, it bears mentioning again that the features of the disclosed grip are designed and intended to accommodate both or either the right or left human hand.

Figure 3:
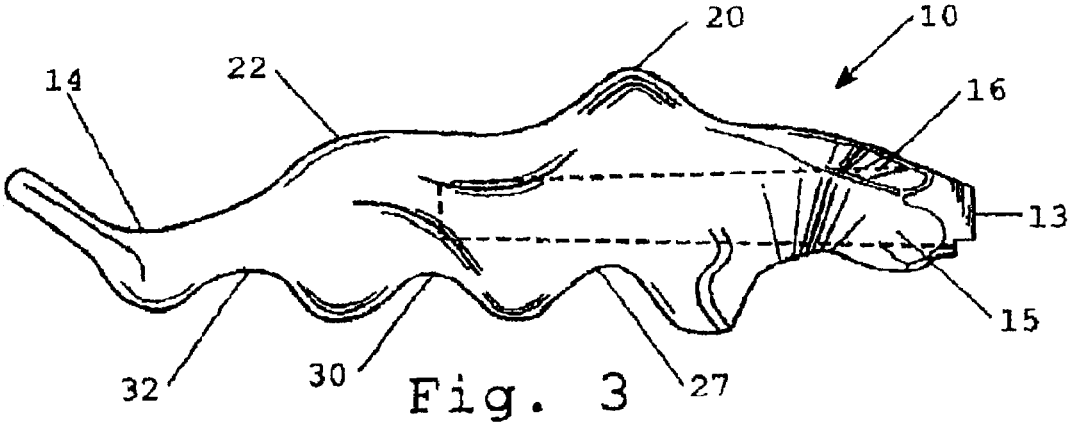
FIG. 3 is an elevated side of the disclosed grip, both sides being similar in form and function.

When either hand is placed over the grip 10 so that the heel of the hand rests in the depression 14 and the thumb and forefinger are separated by ridge 20, the thumb of the hand will naturally position itself on one of three alternative positions or rests. Depending on the size of the hand or intensity of the grasp being applied to the grip 10, the thumb will position itself on the upper rests 16 and 18, lower thumb rest 15 (FIG. 3), or on rests 26 and 28, which are also forefinger rests. Typically, the thumb and forefinger will occupy rests 26 and 28 when the grasp on the grip is particularly intense.

As ridge 20 separates the thumb and forefinger, it also provides lateral support surfaces 21 and 23 for the forefinger. These surfaces are important because typically, or at least frequently, the thumb and forefinger will be applying countervailing forces on the grip 10.

As the heel of the hand rests in depression 14 and the thumb is positioned in any of the aforementioned rests, the palm of the hand is supported by a slight elevation 22 on the dorsal surface. The elevation is designed and intended to comfortably fill the depression created in the palm of the hand when in the typical grasping or gripping orientation.

Figure 4:
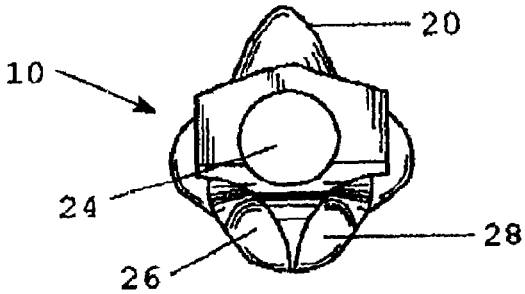
FIG. 4 is an elevated end view of the fore end of the disclosed grip.
Figure 5:
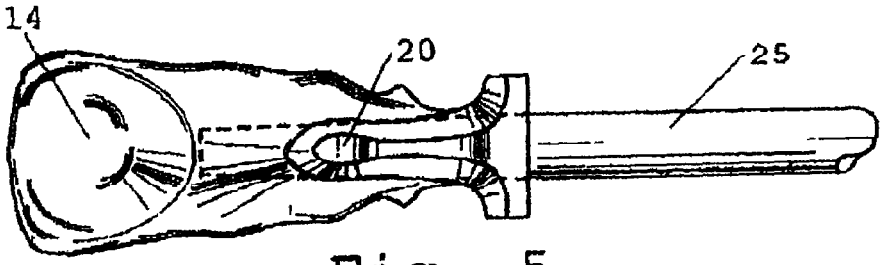
FIG. 5 is a top plan view of the disclosed grip in association with a handle.
Figure 6:
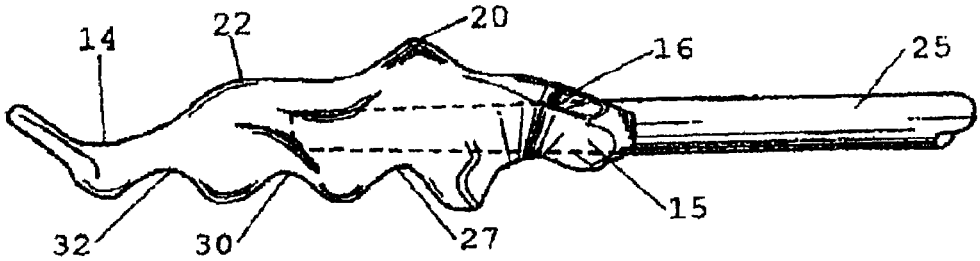
FIG. 6 is an elevated side view of the disclosed grip depicted in FIG. 5.
Figure 7:
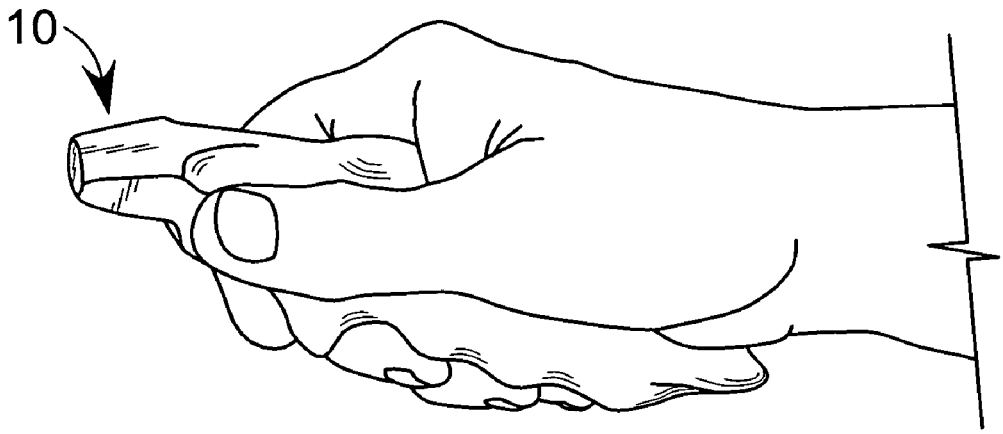
FIG. 7 is a side view depiction of the disclosed grip being held with the thumb placed on the lower thumb rest.
Figure 8:
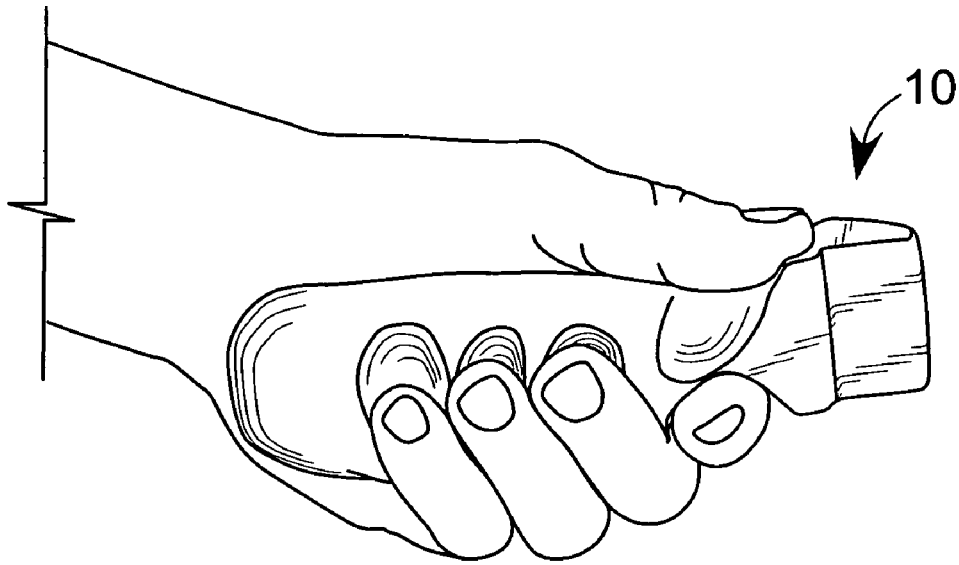
FIG. 8 depicts the ventral surface of the disclosed grip as held in FIG. 7.

It is also intuitive that when the hand is positioned to hold the disclosed grip 10 in a gripping mode, the fingers of the hand will surround the lateral sides 40, 42 of the grip 10. As indicated in FIGS. 1 and 2, lateral side 40 corresponds to the right side of the grip 10, and lateral side 42 corresponds to the left side of the grip. The sides 40, 42 provide structure or body to the grip 10 and one gripping feature: Lower thumb rests 15 (FIGS. 3 4) are positioned at the fore end 13 of the grip, immediately below the upper thumb rests 16 and 18.

As the fingers assume a gripping orientation, the forefinger can be conveniently positioned on either of rests 26 or 28, and the thumb, if the grasp is intense, is positioned on the unoccupied rest. To reiterate, then, the thumb has a variety of grasping positions on the grip, but regardless of where the thumb positions itself, the index finger will occupy either rest 26 or 28.

When properly grasped and utilized, there are no options for the placement of the remaining digits. The middle and ring fingers will naturally position themselves on rests 27 and 30, respectively; and the little finger will wrap onto rest 32.

When grasped in this fashion, the disclosed grip will accommodate all of the structural features of the gripping hand and maximize any effort expended by the upper limb in whatever chore or function being undertaken.

Other features of the disclosed grip 10 include an opening 24 in the fore end 13 of the grip 10 for the insertion of a handle 25. The opening 24, of course, is designed to accommodate a variety of handles, rods or levers 25 used in the execution of a variety of jobs and chores. The disclosed grip 10, of course, when deployed as shown and described, will facilitate the use and improve the efficiency of the work applied to any handle, rod or lever.

The disclosed grip 10 can be fabricated from any of a variety of materials, but some, of course, are more practical than others. Any of a variety of easily molded thermoplastic materials will provide a grip that is easy to fabricate and durable for extended and hard usage. Other rigid materials, such as metals, woods and resins could also be employed to effect a grip according to the teaching of this document. It is also envisioned that the disclosed grip could be constructed of components offering varying rigidity. For instance, a rigid grip could easily be covered with a soft and pliable coating to provide a comfortable "feel" if the grip is being employed more for resting the hand, such as on the arm rest of a chair, than for facilitating the work of the hand. However, a hard working tool could also be equipped with a grip having a soft, spongy coating.

While the foregoing is a detailed and complete description of the preferred embodiment of the disclosed grip, it should be apparent that numerous variations and modifications can be made and employed to implement the overall purpose of the disclosed device without departing from the spirit of the invention, which is fairly defined by the appended claims.

The invention claimed is:

1. A grip symmetrical about a vertical plane passing therethough to accommodate the ambidextrous grasp of the human hand, and wherein said grip equally accommodates the right and left hand grasps, providing an enhanced gripping surface, said grip comprising:

a body having a dorsal surface with a depression for the heel of said hand, a prominence for the palm of said hand, an elevated ridge to separate the thumb and forefinger of said hand, and a depression for the placement of the thumb of said hand;

a ventral surface having a plurality of depressions for the placement of the finger tips of the four digits of said hand; and two lateral surfaces separating said dorsal surface and said ventral surface.

2. The grip according to claim 1 wherein the lateral surfaces each provides an alternative placement for the thumb.

3. The grip according to claim 1 wherein the ventral surface also provides a depression for the placement of the thumb.

4. The grip according to claim 1 having an opening in its fore end to accommodate a handle.

* * * * *